United States Patent [19]

Seaholm

[11] 4,064,667

[45] Dec. 27, 1977

[54] DECORATIVE JAMB STRUCTURE FOR ELEVATOR ENTRANCEWAYS

[75] Inventor: Reuel A. Seaholm, Arkansas City, Kans.

[73] Assignee: Montgomery Elevator Company, Moline, Ill.

[21] Appl. No.: 712,332

[22] Filed: Aug. 6, 1976

[51] Int. Cl.[2] ..... E06B 1/04

[52] U.S. Cl. ..... 52/204; 52/215

[58] Field of Search ..... 52/204, 127, 202, 311, 52/312, 474, 506, 509, 510, 511, 512, 269, 283, 284, 215

[56] References Cited

U.S. PATENT DOCUMENTS

| | | | |
|---|---|---|---|
| 1,701,679 | 2/1929 | Johnson | 52/215 |
| 1,836,724 | 12/1931 | Oakley | 52/312 |
| 2,579,943 | 12/1951 | Marchand | 52/312 |
| 3,103,708 | 9/1963 | Pomeroy et al. | 52/311 X |

*Primary Examiner*—J. Karl Bell

*Attorney, Agent, or Firm*—Wegner, Stellman, McCord, Wiles & Wood

[57] ABSTRACT

A decorative jamb structure for a side of an entranceway through a wall from a corridor to an elevator hatchway that has a sliding door in the hatchway. The jamb structure includes a shroud covering the end of the wall, the shroud having vertical side elements and a recessed connecting web that define a vertical central channel, a decorative panel removably mounted in the channel by means of headed studs impaling vertical keyhole openings in the web, and a base plate in the channel which is detachably secured to the web and supports the decorative panel with the studs in the narrow upper end portions of the keyhole openings.

19 Claims, 5 Drawing Figures

DECORATIVE JAMB STRUCTURE FOR ELEVATOR ENTRANCEWAYS

BACKGROUND OF THE INVENTION

It is well known that a significant factor in present day passenger elevator installations is the aesthetic effect achieved by the visible parts of the entire system. Considerable amounts of design work have been done to produce attractive components which will enhance the appearance of a building corridor. In this regard, of course, one of the most noticeable parts of any elevator system is the entranceway between the corridor and the elevator hatchway, and the sliding door or doors in the hatchway which ordinarily close the entranceway and open for access to the elevator car.

Heretofore, the jambs for elevator entranceways have either been stock items which lack much individuality, or else they have been expensive, custom designed components which are built to create a harmonious effect with the interior decoration of the corridor and with the forward surface of the sliding hatchway door. There has been no relatively inexpensive and simple structure for permitting the low cost "customizing" of the jambs of elevator hatch entranceways. Further, except for changes in appearance which might be produced by repainting jambs in a new color, there has been no way to change the appearance of an elevator entranceway except by completely rebuilding it.

SUMMARY OF THE INVENTION

In accordance with the present invention, each jamb for the side of an entranceway consists of a metal shroud structure which covers the end of the wall in which the entranceway is formed, and removable insert means. The shroud structure has vertical side elements between which there is a recessed connecting web, so that the side elements and the web define a channel of any desired width. The shroud structure has a lower end at the floor structure and an upper end at a top cross structure of the entranceway. The insert means include core means and decorative sheath means fixed to the core means, and has lower and upper ends which are substantially coterminous with those of the shroud structure. Studs fixed to one area of the core means impale holes in one of the structures, and fasteners in another area of the core means are detachably secured to the connecting web means.

In a preferred structure the removable insert means comprises a decorative panel which is shorter than the shroud structure and a finishing plate which abuts one of the ends of the decorative panel. The studs are headed and engage vertically elongated holes of keyhole shape which are in the connecting web means of the shroud structure, and the finishing plate prevents disengagement of the studs from the holes by endwise movement of the decorative panel.

In addition to the preferential structure described in the last paragraph, it is further preferred that the fasteners in the other area of the core means be threaded fasteners in the finishing plate which screw into the connecting web means and are captive beneath the decorative sheath means, with small holes in the decorative sheath means through which a thin bladed tool may be inserted to rotate the threaded fasteners. The holes in the decorative sheath means may be so small that they are quite unobtrusive, and the use of Allen screws for the fasteners makes the structure effectively tamperproof.

The present structure permits the strength and safety of a heavy gauge sheet metal shroud which may be stainless steel, natural or oxidized bronze, aluminum alloy with any desired surface treatment, or steel with a baked enamel or vinyl coating. The base member may have an outer shell which matches the shroud; while the decorative insert may have any desired surface appearance such, for example, as a wood grain Formica sheath which matches the outer surface of the sliding door. Alternatively, of course, the decorative panel may be covered with any desired surface material such as a fabric or wallpaper, pictorial matter, or informational material such as a store directory. The appearance of the entranceway may be readily changed by removing the base to release the decorative panel from the keyhole slots, replacing the decorative panel with a new one, and again installing the base.

THE DRAWINGS

DETAILED DESCRIPTION OF THE INVENTION

Figure 1:
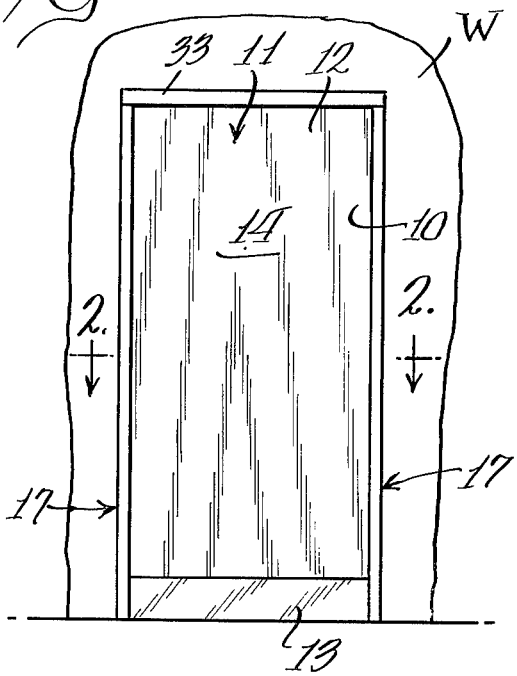
FIG. 1 is a front elevational view of the structure of the present invention, illustrated with a typical sliding hatch door in its closed position.

Referring to the drawings in detail, a wall W is constructed between a corridor C which has a floor structure F, and a hatchway H in which an elevator travels vertically. Formed in the wall W is an entranceway 10; and normally closing the entranceway is a sliding door 11 which is illustrated only diagrammatically in FIGS. 2 and 4. As seen in FIG. 1, the door 11 has a main panel 12 and a base 13. Typically, the door 11 has a core with decorative surfaces 14 and 15 facing the corridor C and the hatchway H, and these decorative surfaces may, for example, be provided by wood grain Formica bonded to the core. The base 13 commonly is a sheet of metal such as stainless steel which is also bonded to the core.

The wall W has ends 16 which form the two sides of the rough entranceway; and the decorative jamb structures of the present invention, indicated generally at 17, conceal the ends 16 of the wall.

The jambs 17 are mirror images of one another, so that only one will be described in detail, and the same reference numerals will be applied to the various parts of both jambs. Each jamb 17 includes a shroud structure, indicated generally at 18; a decorative panel, indicated generally at 19, which is shorter than the shroud 18; and a finishing plate, indicated generally at 20, which in the present instance is a base plate and fills the space between the bottom of the decorative panel 19 and the floor structure F.

Figure 2:
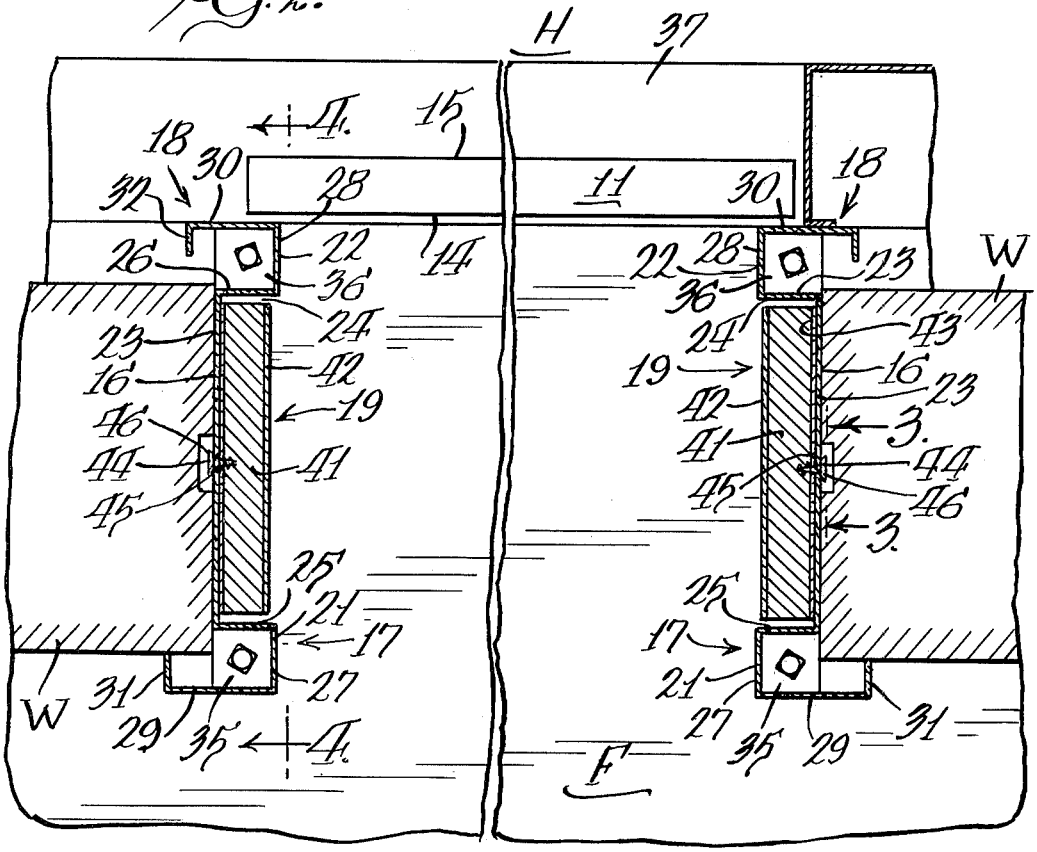
FIG. 2 is a horizontal sectional on an enlarged scale taken substantially as indicated along the line 2—2 of FIG. 1.

Referring now particularly to FIG. 2, each of the shrouds 18 has a lower end **18*a* at the floor structure and an upper end 18*b*** at a decorative top cross structure 33 of the entranceway, and includes a vertical side element 21 at the corridor side of the wall, a vertical side element 22 at the hatchway side of the wall, and a recessed connecting web 23 between the side elements 21 and 22 and defining with them a central channel 24. The side elements 21 and 22 include, respectively, inner webs 25 and 26 which are perpendicular to the connecting web 23 and form the sides of the channel 24, forward webs 27 and 28 perpendicular to the inner webs 25 and 26, lateral webs 29 and 30 which are parallel to and wider than the webs 25 and 26 so as to overlap the end 16 of the wall W, and return webs 31 and 32 one of which is seen to bear against the corridor side of the wall W.

Figure 4:
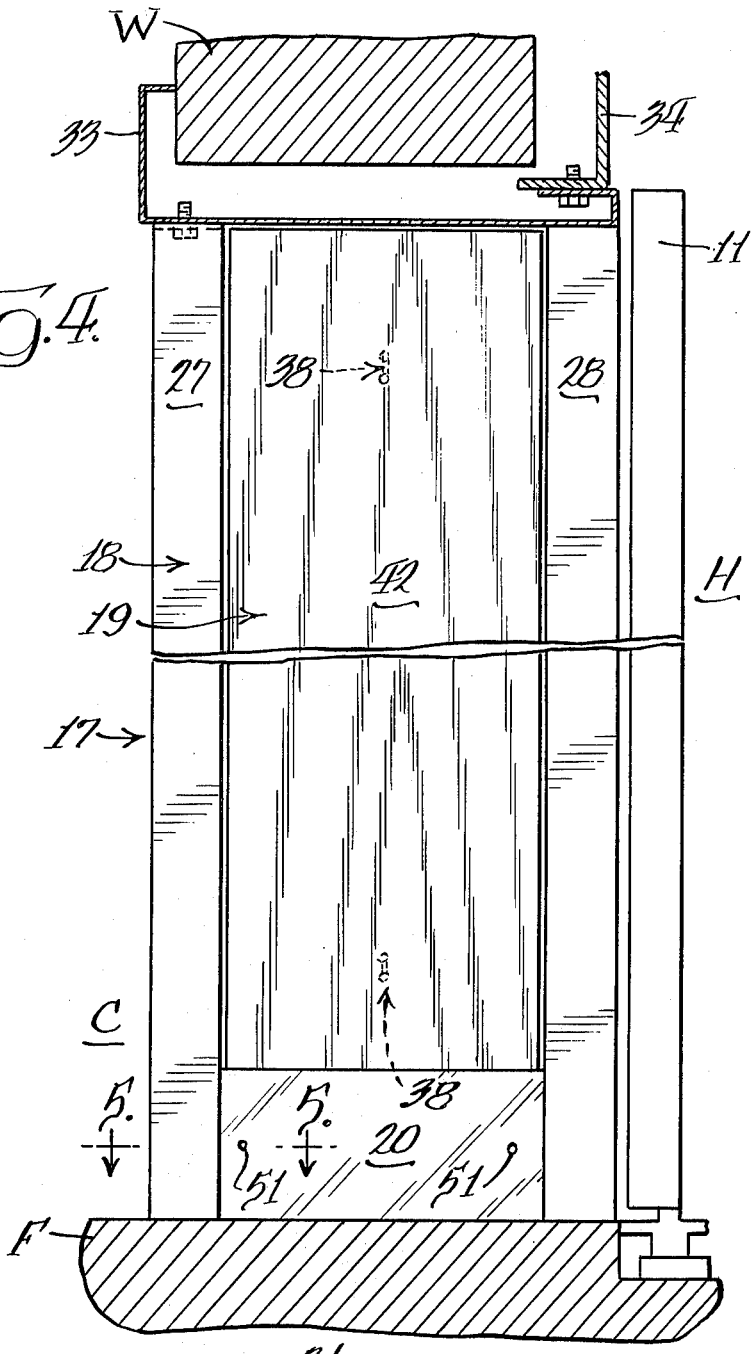
FIG. 4 is a vertical, sectional view taken substantially as indicated along the line 4—4 of FIG. 2.

As seen in FIG. 4, the decorative top cross structure 33 for the entranceway provides a support for the corridor side of the shroud 18; and a structural member 34 which provides support for the sliding door 11 affords an upper attachment for the hatchway side of said shroud; and as seen in FIG. 2 transverse plates 35 at the lower ends of the side elements 21 and transverse plates 36 at the lower ends of the side elements 22 receive lag bolts for securing the lower ends of the shroud means 18 to the floor structure F. From the floor structure a sill 37 extends into the hatchway H beneath the sliding door 11.

Figure 3:
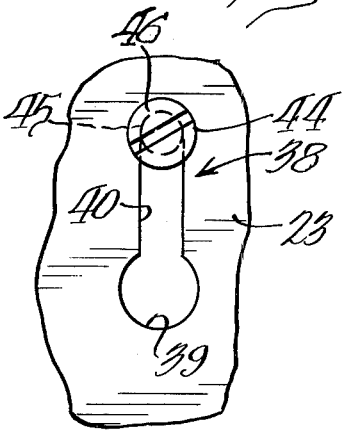
FIG. 3 is a fragmentary elevational view on an enlarged scale taken substantially as indicated at 3—3 in FIG. 2.

Referring now to FIGS. 2, 3 and 4, the connecting web means 23 is provided with at least two keyhole shaped openings, indicated generally at 38, each of which is vertically oriented and has enlarged, circular lower portion 39 and an upper slot portion 40 which provide part of the means for detachably securing the decorative panels 19 in the channels 24.

Each of the decorative panels 19 includes a wooden core 41 which has a decorative outer surface 42 which may, for example, match the wood grain outer surface 14 of the sliding door 11. Secured to the rear face 43 of the decorative panel 19 is a plurality of fasteners 44 each of which impales one of the holes 38 in the connecting web 23 in such a manner as to detachably mount the decorative panel 19 in the channel 24 in firm abutment with the connecting web means. In the illustrated preferred embodiment, the fasteners 44 consist of headed studs having very short shanks 45 and heads 46. The shanks 45 are narrower than the upper slot portions 40 of the keyhole openings 38, while the heads 46 are wider than said slot portions but smaller than the circular lower end portions 39, as is usual for connections of this type. Thus, the heads 46 of the studs may be inserted through the circular openings 39 and the decorative panels 19 may then be slid upwardly so that the fasteners 44 occupy the position illustrated in FIG. 3. The base plates 20 are then positioned beneath the decorative panels 19 as seen in FIG. 4, and secured in place to support the decorative panels.

Figure 5:
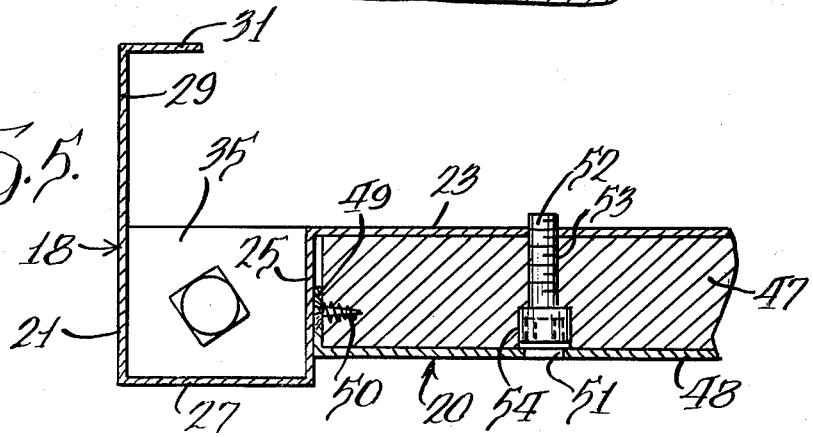
FIG. 5 is a fragmentary sectional view on an enlarged scale taken substantially as indicated along the line 5—5 of FIG. 4.

As best seen in FIG. 5, the base plate 20 consists of a wood core 47 and a metal sheath 48 the end portions 49 of which are bent around the ends of the core 47 and receive fastening screws 50 by means of which the sheath 48 is secured to the core, and in addition a bonding material is preferably used between the sheath 48 and the core 47. The sheath is provided with two holes 51 through which a tool may be inserted to rotate captive Allen screws 52 by means of which the base plate 20 is secured to the connecting web 23. In order to accommodate the Allen screws the core 47 is provided with through bores 53 having counter bores 54 to receive the heads of the Allen screws 52. Although the different scales of FIG. 1 and FIG. 4 do not so indicate, in practice the base plate 13 on the door and the base plate 20 of the jamb structure are the same height.

It is apparent from the foregoing description that the decorative panel 19 and the base plate 20 collectively provide removable insert means having lower and upper ends which are substantially coterminous with those of the shroud structure, and the insert means includes core means and decorative sheath means which is fixed to the core means. The removable insert means is detachably secured in the channel with the core means abutting the connecting web means. The headed studs which engage the keyhole openings and the Allen screws which mount the base plate collectively constitute a mounting means which detachably secure the removable insert means (consisting of the decorative panel and the base plate) in the channel.

The foregoing detailed description is given for clearness of understanding only and no unnecessary limitations should be understood therefrom as modifications will be obvious to those skilled in the art.

I claim:

1. A decorative jamb for a side of an entranceway that extends through a wall between an elevator hatchway and a building corridor having a floor structure, so that the sides of the entranceway are defined by end surfaces of the wall, there being a top cross structure in the entranceway and a sliding door in the hatchway which normally closes said entranceway, said decorative jamb comprising, in combination:

a shroud structure which has a lower end at the floor structure and an upper end at the top cross structure of the entranceway to conceal the end surface of the wall, said shroud structure having two vertical side elements which are joined by recessed connecting web means to define a vertically extending central channel;

removable insert means including core means and decorative sheath means fixed to said core means, said insert means having lower and upper ends which are substantially coterminous with those of the shroud structure;

and mounting means detachably securing said removable insert means in said channel with the core means abutting the connecting web means, said mounting means comprising studs fixed to one area of the core means which impale holes in one of the structures, and threaded fasteners in another area of the core means which are captive beneath the decorative sheath means and screw into the connecting web means, there being small holes in the decorative sheath means through which a tool may be inserted to rotate said threaded fasteners.

2. The combination of claim 1 in which the removable insert means comprises a decorative panel which is shorter than the shroud structure and a finishing plate which abuts one of the ends of the decorative panel, the studs of the mounting means are headed and engage vertically elongated holes of keyhole shape which are in the connecting web means of the shroud structure, and the threaded fasteners are in the finishing plate, said finishing plate preventing disengagement of the studs from the holes by endwise movement of the decorative panel.

3. The combination of claim 2 in which the finishing plate is a base plate which supports the decorative panel.

4. The combination of claim 2 in which the finishing plate and the decorative panel are substantially the same thickness.

5. The combination of claim 4 in which the thickness of the decorative panel and the finishing plate is no greater than the depth of the channel in the shroud structure.

6. The combination of claim 1 in which the threaded fasteners are Allen screws.

7. The combination of claim 1 in which the shroud structure consists of a single piece of rigid sheet material.

8. The combination of claim 1 in which the shroud structure consists of rigid sheet material, and the removable insert means comprises a decorative panel with decorative sheath means that contrasts in appearance with the shroud structure.

9. The combination of claim 1 in which the removable insert means comprises a decorative panel which is narrower than the connecting web means and is centered in the channel.

10. The combination of claim 1 in which the shroud structure consists of sheet material which is formed to provide box-like side elements that have inner webs perpendicular to the connecting web means that form the sides of the channel, forward webs extending laterally outwardly from the inner webs, lateral webs spaced from the inner webs that are outside the planes of the wall side surfaces, and return webs one of which has a free edge abutting the corridor side of the wall.

11. The combination of claim 1 which includes flanges at the top and bottom of the shroud structure, said flanges being adapted to receive fasteners by means of which the shroud structure is secured to the top cross structure and to the floor structure.

12. A decorative jamb for a side of an entranceway that extends through a wall between an elevator hatchway and a building corridor having a floor structure, there being a decorative top cross structure in the entranceway and a sliding door in the hatchway which normally closes said entranceway, said jamb structure comprising, in combination:

a decorative shroud structure which extends from the floor structure to the decorative top cross structure of the entranceway to conceal the end surface of the wall, said shroud structure having two vertical side elements which are joined by recessed connecting web means to define a vertically extending central channel, and there being a plurality of holes in said connecting web means;

a decorative panel in said channel which is shorter than the shroud structure;

a plurality of fasteners secured to the rear face of said decorative panel, each of said fasteners impaling a hole in the connecting web means and having an enlarged head toward its distal end so as to detachably mount the decorative panel in the channel in firm abutment with said connecting web means;

a finishing plate in said channel abutting an end of the decorative panel, said finishing plate filling the space between said end of the decorative panel and the adjacent end of the channel;

and means detachably securing said finishing plate to the connecting web means.

13. The combination of claim 12 in which the holes in the connecting web means are of keyhole shape with enlarged lower end portions and narrow upper portions, the fasteners are rigid, headed studs having shanks narrower than said upper portions and heads wider than the upper portions but smaller than the enlarged lower end portions, and the finishing plate is a base plate upon which the decorative panel is supported.

14. The combination of claim 12 in which the finishing plate comprises a wood core, a sheath secured to said core, there being a pair of holes in said sheath, bores through the wood core aligned with said holes in the sheath, said bores including countersunk portions facing the sheath, and fastening screws in said bores which are captive beneath the sheath, said fastening screws being rotatable by means of a tool inserted through the hole in the sheath to detachably secure the finishing plate to the connecting web means.

15. A decorative jamb for a side of an entranceway that extends through a wall between an elevator hatchway and a building corridor having a floor structure, so that the sides of the entranceway are defined by end surfaces of the wall, there being a top cross structure in the entranceway and a sliding door in the hatchway which normally closes said entranceway, said decorative jamb comprising, in combination:

a shroud structure which has a lower end at the floor structure and an upper end at the top cross structure of the entranceway to conceal the end surface of the wall, said shroud structure having two vertical side elements which are joined by recessed connecting web means to define a vertically extending central channel;

removable insert means including core means and decorative sheath means fixed to said core means, said insert means having a lower end which is substantially coterminous with the lower end of the shroud structure;

and mounting means detachably securing said removable insert means in said channel with the core means abutting the connecting web means, said mounting means comprising studs fixed to one area of the core means which impale holes in one of the structures, said studs being disengageable from said holes only by vertical movement of the removable insert means, and fasteners in another area of the core means which engage the connecting web means and are disengageable therefrom only by horizontal movement, whereby engagement of said fasteners with the connecting web means precludes vertical movement of said removable insert means, said fasteners being accessible for manual removal while being effectively concealed by the decorative sheath means.

16. The combination of claim 15 in which the fasteners are screws which extend through the core means and are captive beneath the decorative sheath means, and in which small holes in said decorative sheath means permit insertion of an implement for manually rotating the screws.

17. A decorative jamb for a side of an entranceway that extends through a wall between an elevator hatchway and a building corridor having a floor structure, there being a decorative top cross structure in the entranceway and a sliding door in the hatchway which normally closes said entranceway, said jamb structure comprising, in combination:

a decorative shroud structure which extends from the floor structure to the decorative top cross structure of the entanceway to conceal the end surface of the wall, said shroud structure having two vertical side elements which are joined by recessed connecting web means to define a vertically extending central channel;

a decorative panel in said channel which is shorter than the shroud structure;

studs fixed to the core means which impale holes in one of the structures to detachably secure said decorative panel in the channel in form abutment with the connecting web means;

a finishing plate in said channel abutting an end of the decorative panel, said finishing plate and decorative panel cooperating to occupy the channel from end to end to prevent vertical movement of the decorative panel;

and means detachably securing said finishing plate to the connecting web means.

18. The combination of claim 17 in which the holes impaled by the studs are in the connecting web means and are of keyhole shape with enlarged lower end portions and narrow upper portions, the studs have rigid shanks narrower than said upper portions and rigid heads wider than the upper portions but smaller than the enlarged lower end portions, and the finishing plate is a base plate upon which the decorative panel is supported.

19. The combination of claim 17 in which the finishing plate comprises a wood core, a sheath secured to said core, there being a pair of holes in said sheath, bores through the wood core aligned with said holes in the sheath, said bores including countersunk portions facing the sheath, and fastening screws in said bores which are captive beneath the sheath, said fastening screws being rotatable by means of a tool inserted through the hole in the sheath to detachably secure the finishing plate to the connecting web means.

* * * * *